US006458266B1

(12) United States Patent
Lin et al.

(10) Patent No.: US 6,458,266 B1
(45) Date of Patent: Oct. 1, 2002

(54) CATALYTIC REFORMING PROCESS WITH INHIBITION OF CATALYST DEACTIVATION

(75) Inventors: Fan-Nan Lin; John S. Parsons, both of Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/668,190

(22) Filed: Sep. 22, 2000

Related U.S. Application Data

(60) Provisional application No. 60/167,468, filed on Nov. 24, 1999.

(51) Int. Cl.[7] ..... C10G 35/085

(52) U.S. Cl. ..... 208/139; 208/135; 208/137; 208/138; 208/134; 208/140; 208/63; 208/64; 208/65; 502/20; 502/22; 502/32

(58) Field of Search ..... 208/134, 135, 208/137, 138, 139, 140, 63, 64, 65; 502/20, 22, 32

(56) References Cited

U.S. PATENT DOCUMENTS

| | | | | |
|---|---|---|---|---|
| 2,952,611 A | | 9/1960 | Haxton et al. | 208/65 |
| 3,649,524 A | | 3/1972 | Derr et al. | 208/139 |
| 3,705,095 A | | 12/1972 | Dalson et al. | 208/65 |
| 4,059,645 A | * | 11/1977 | Jacobson | 260/668 A |
| 4,066,740 A | * | 1/1978 | Ericson | 423/628 |
| 4,832,821 A | | 5/1989 | Swan, III | 208/65 |
| 5,318,689 A | * | 6/1994 | Hsing et al. | 208/70 |
| 5,360,534 A | * | 11/1994 | Rice et al. | 208/139 |
| 6,013,847 A | * | 1/2000 | Lin | 585/269 |
| 6,140,546 A | * | 10/2000 | Lin et al. | 585/419 |
| 6,140,547 A | * | 10/2000 | Lin et al. | 585/743 |

* cited by examiner

*Primary Examiner*—Nadine Preisch
(74) *Attorney, Agent, or Firm*—Jeffrey R. Anderson

(57) ABSTRACT

A substantially water-free hydrocarbon feed is charged to a multiple-reactor reformer system being operated under reforming conditions and comprising at least two reformer reactors serially connected in fluid-flow communication and each containing a reformer catalyst; and, simultaneously with the charging step, a chloriding agent is sequentially introduced, without simultaneously introducing water, immediately upstream from the inlets of all the reformer reactors in an amount and for a period of time that are effective to inhibit the deactivation of the reformer catalyst.

34 Claims, 5 Drawing Sheets

CATALYTIC REFORMING PROCESS WITH INHIBITION OF CATALYST DEACTIVATION

This application claims the benefit of U.S. Provisional Application Ser. No. 60/167,468, filed Nov. 24, 1999.

This invention relates to an improved catalytic reforming process. In another aspect, this invention relates to a method of operating a multiple-reactor reforming system whereby the rate of deactivation of the reforming catalyst is minimized.

BACKGROUND OF THE INVENTION

Catalytic reforming is a well established refining process employed by the petroleum industry for upgrading low-octane hydrocarbons to higher-octane hydrocarbons. Typically, catalytic reforming involves the contacting of a naphtha hydrocarbon feed with a reformer catalyst under elevated temperatures and pressures.

Reformer catalysts typically comprise a metal hydrogen transfer component or components, a halogen component, and a porous inorganic oxide support. A reformer catalyst which has been employed widely throughout the petroleum industry comprises platinum as the metal hydrogen transfer component, chlorine as the halogen component, and alumina as the support. Also, additional metallic promoter components, such as rhenium, iridium, ruthenium, tin, palladium, germanium and the like, have been added to the basic platinum-chlorine-alumina catalyst to create a bimetallic catalyst with improved activity, selectivity, or both.

In a conventional reforming process, a series of two to five reformer reactors constitute the heart of the reformer system. Each reformer reactor is generally provided with a fixed bed or beds of catalyst which receive upflow or downflow feed. Each reactor is provided with a heater because the reactions which take place therein are predominantly endothermic. In a typical commercial reformer, a naphtha feed with a diluent of hydrogen or hydrogen recycled gas is passed through a preheat furnace, then downward through a reformer reactor, and then in sequence through subsequent interstage heaters and reactors connected in series. The product of the last reactor is separated into a liquid fraction and vaporous effluent. The vaporous effluent, a gas rich in hydrogen, may then be used as hydrogen recycled gas in the reforming process.

During operation of a conventional catalytic reformer system, the activity of the reformer catalyst gradually declines over time. There are believed to be several causes of reformer catalyst deactivation, including, (1) formation of coke within the pores, as well as on the surface, of the catalyst, (2) agglomeration of the catalyst metal component or components, and (3) loss of the halogen component. Deactivation of a reformer catalyst can have the following negative impacts on the reforming process: (1) lower product octane number; (2) higher required reaction temperature; (3) higher required reaction pressure; (4) decreased time between required catalyst regeneration (cycle time); (5) increased requirement for hydrogen; and (6) decreased selectivity.

It has been previously recognized that the deactivation of a reformer catalyst can be inhibited by contacting the reformer catalyst with a chloriding agent during reforming. This "chloriding" of the reformer catalyst is thought to inhibit catalyst deactivation by (1) counteracting the formation of coke on the catalyst, (2) redispersing the metal component or components of the catalyst in a more uniform manner, and (3) replacing the halogen component which has been stripped from the catalyst during reforming.

The conventional practice of chloriding a reformer catalyst contained in the reformer reactors of a multiple-reactor reformer system is to inject a chloriding agent into the hydrocarbon feed charged to the first reactor of the series. The chloriding agent is then carried with the hydrocarbon feed to the reaction zone of the first reformer reactor and subsequently to the reaction zones of the downstream reactors where it is contacted with the reformer catalyst. An important aspect of the conventional chloriding practice is for the water concentration in the feed to the first reactor of the multiple-reactor reformer system to be maintained and even controlled within a certain concentration range while adding the chloriding agent. This is done in order to keep the water-chloride ratio within the reformer reaction zones at an appropriate level so as to maintain both catalyst activity and stability by suppressing the excessive hydrocracking that is believed to occur during conventional chloriding. The water concentration in the reformer feed is also maintained at certain levels in order to aid in carrying the chloriding agent through the series of reformer reactors so as to properly expose the catalyst contained in the downstream reactors to the chloriding agent.

A disadvantage of conventional reforming methods which require the presence of water in the hydrocarbon feed charged the multiple-reactor reforming system is that water can cause accelerated coking, and thus, accelerated deactivation, of the reformer catalyst. A further disadvantage of requiring the presence of water in the hydrocarbon feed is that water can strip the halogen component from the reformer catalyst causing decreased activity and decreased stability. A still further disadvantage of conventional reforming methods is that the reformer catalyst contained in the downstream reactors of the multiple-reactor reformer system experiences an accelerated rate of deactivation when compared to the reformer catalyst in the upstream reactors of the system, thus decreasing the time between which the entire system must be shut down for regeneration of the reformer catalyst (i.e., decreased cycle time).

SUMMARY OF THE INVENTION

It is an object of the present invention to provide an improved reforming process whereby the stability of a reformer catalyst is improved when compared with reforming processes utilizing conventional methods.

It is a further object of this invention to solve problems associated with the use of water as a means for aiding in the conveyance of a chloriding agent from the first reactor of a series of reactors in a multiple-reactor reformer system to the downstream reactors of the series.

It is yet a further object of this invention to provide for the reduction or substantial elimination of water in the feed to the reformer system in order to take advantage of the benefits of processing a dry reformer feed while simultaneously eliminating the disadvantages of processing a dry reformer feed.

A still further object of this invention is to provide for the controlled introduction of a chloriding agent into each of a series of reformer reactors, without the simultaneous introduction of water, in a manner which provides the benefits of the chloriding agent in each of the reactors of the series while realizing the advantages of not having to use water as a carrying aid for the chloriding agent.

An even further advantage of the present invention is that the accelerated rate of deactivation of the reformer catalyst contained in the downstream reactors, versus the upstream reactors, of the multiple-reactor reformer system is counteracted or eliminated, thus decreasing cycle time for the entire system.

Further objects and advantages of the present invention will become apparent from consideration of the detailed description of the invention and appended claims.

Accordingly, in one embodiment of the invention, an improved reforming process is provided in which the stability of the reformer catalyst contained in all the reactors of the multiple-reactor reformer system is significantly improved as compared with other conventional reforming processes. This improved reforming process includes charging a substantially water-free reformer feed comprising a reformable hydrocarbon to a reformer system comprising at least two reactors serially connected in fluid-flow communication, with each reactor containing at least a volume of reformer catalyst and operating under reforming conditions. While the substantially water-free reformer feed is being charged to the multiple-reactor reformer system, a chloriding agent is introduced, without simultaneously introducing water, immediately upstream from the inlets of all the reformer reactors in an amount and for a period of time that is effective to inhibit the deactivation of the reformer catalyst. The introduction of the chloriding agent into all the reformer reactors of the multiple-reactor reformer system must occur sequentially, with only one reactor at a time receiving an injection of the chloriding agent.

In another embodiment of the invention, the deactivation of a reformer catalyst of a reformer system comprising an initial reactor, at least one intermediate reactor, and a final reactor serially connected in fluid-flow communication is inhibited or counteracted by charging a substantially water-free hydrocarbon feed to the reformer system while operating under reforming conditions. While the substantially water-free hydrocarbon feed is being charged to the reformer system, a chloriding agent is introduced, without the simultaneous introduction of water, into the inlet of each of the initial reactor, the intermediate reactor or reactors, and the final reactor in an amount and for a time period that are effective to inhibit the deactivation of the reformer catalyst. The introduction of the chloriding agent into the initial reactor, the intermediate reactor or reactors, and the final reactor must occur sequentially, with only one reactor at a time receiving an injection of the chloriding agent.

A still further embodiment of the invention includes a method of operating a reformer system that has a first reactor, a second reactor, and a third reactor. The first reactor has a first inlet for receiving a feed and a first outlet for discharging a first effluent and defines a first volume containing a first catalyst. The second reactor has a second inlet for receiving a first effluent and a second outlet for discharging a second effluent and defines the second volume containing a second catalyst. The third reactor has a third inlet for receiving the second effluent and a third outlet for discharging a third effluent and defines a third volume containing a third catalyst. A first conduit means is operatively connected to the first inlet and provides for conveying the feed to the first reactor. A second conduit means is operatively connected to the first outlet and the second inlet and provides for fluid-flow communication between the first reactor and the second reactor and for the conveyance of the first effluent from the first reactor to the second reactor. A third conduit means is operatively connected to the second outlet and the third inlet and provides for fluid-flow communication between the second reactor and the third reactor and for the conveyance of the second effluent from the second reactor to the third reactor. A fourth conduit means is operatively connected to the third outlet which provides for conveyance of the third effluent from the third reactor. The inventive method includes charging a substantially water-free hydrocarbon feed comprising a reformable hydrocarbon to the reformer system that is operated under reforming conditions through the first conduit means. Simultaneously with the charging step, a chloriding agent is introduced into the first conduit means without the simultaneous introduction of water in an amount sufficient to provide a concentration of the chloriding agent in the substantially water-free hydrocarbon feed in the range of from about 0.1 ppmw to about 10 ppmw. Thereafter, simultaneously with the charging step, the introduction of the chloriding agent into the first conduit means is terminated. Thereafter, simultaneously with the charging step, a chloriding agent is introduced into the second conduit means without the simultaneous introduction of water in an amount sufficient to provide a concentration of the chloriding agent in the substantially water-free hydrocarbon feed in the range of from about 0.1 ppmw to about 10 ppmw. Thereafter, simultaneously with the charging step, the introduction of the chloriding agent into the second conduit means is terminated. Thereafter, simultaneously with the charging step, a chloriding agent is introduced into the third conduit means without the simultaneous introduction of water in an amount sufficient to provide a concentration of the chloriding agent in the substantially water-free hydrocarbon feed in the range of from about 0.1 ppmw to about 10 ppmw. Thereafter, simultaneously with the charging step, the introduction of the chloriding agent into the third conduit means is terminated.

DETAILED DESCRIPTION OF THE INVENTION

Figure 1:
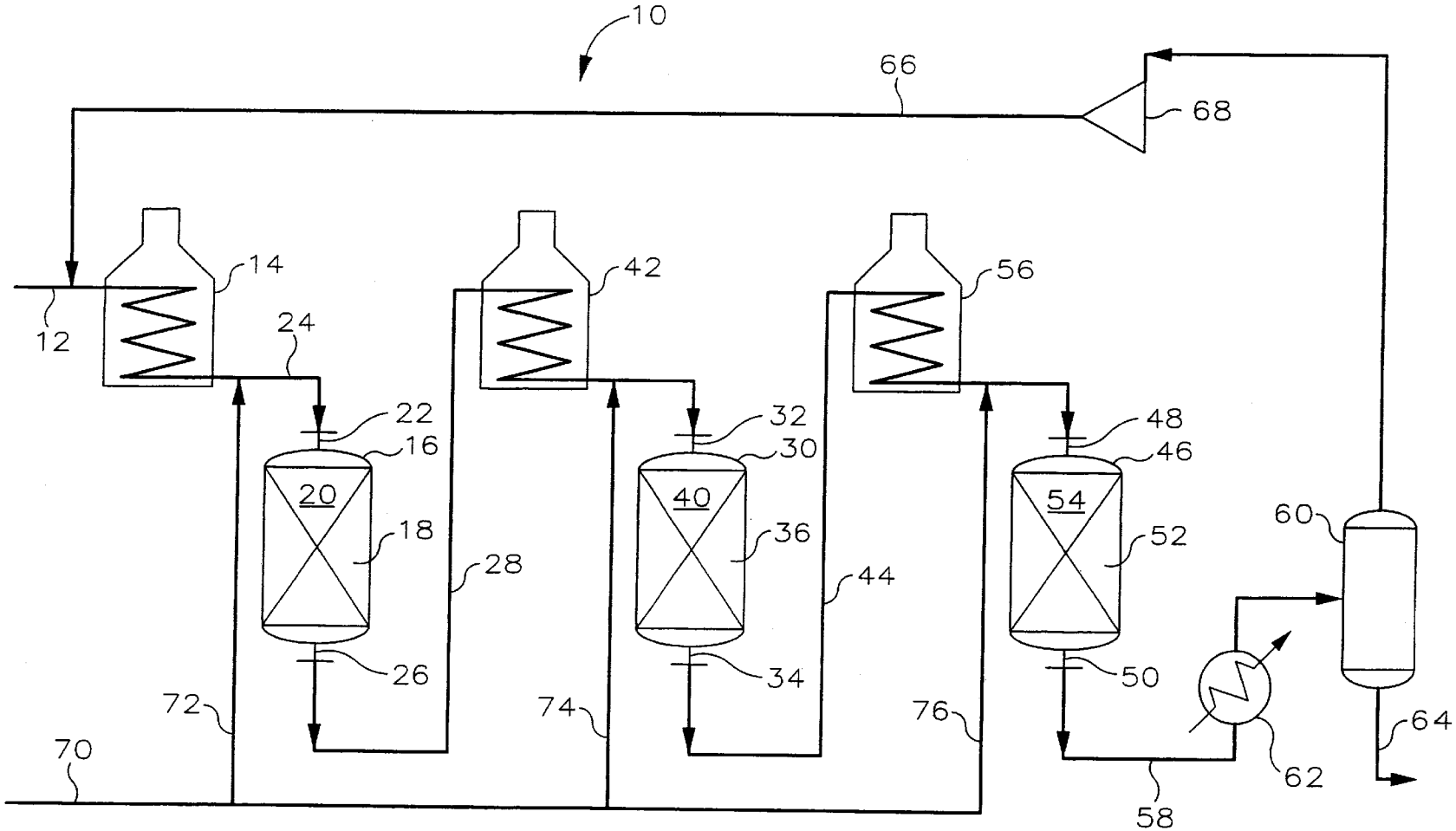
FIG. 1 is a schematic representation of one embodiment of the inventive process.

It has been learned that in appropriate circumstances it can be desirable to charge a multiple-reactor reforming system having a series of reformer reactors containing a reformer catalyst with a dry reformer feedstock that has a very low concentration of water and, in particular, it is desirable for such dry reformer feedstock to be super-dry, and preferably, significantly, or most preferably, substantially free of water. The performance of a reformer catalyst appears to improve as a result of processing a dry reformer feed versus a wet reformer feed. Both catalyst activity and stability improve as a result of processing a dry reformer feed. This is believed to be due to less coking of the reformer catalyst, less stripping of the halogen component from the reformer catalyst, and other favorable reaction conditions due to the presence of a lower concentration of water in the reformer reaction zone.

One problem, however, resulting from the processing of a dry reformer feed in a multiple-reactor reformer system is that when it is beneficial to treat the reformer catalyst with a chloriding agent, the lack of water in the dry reformer feed results in the chloriding agent being deposited primarily on the reformer catalyst contained in the first reactor of the series, with the reformer catalyst of the downstream reactors not being exposed to a desirable amount of the chloriding agent. This method of chloriding results in the accelerated deactivation of the reformer catalyst contained in the downstream reactors of the multiple-reactor reformer system. The accelerated catalyst deactivation in the downstream reactors is believed to be caused, at least in part, by not having enough water present in the dry reformer feed to aid in carrying or moving the chloriding agent downstream with the dry reformer feed.

The invention described and claimed herein solves some of the problems related to charging a dry reformer feed to a multiple-reactor reformer system while adding a chloriding agent to the dry reformer feed. At the same time, the present invention exploits the advantages of reforming hydrocarbons in a substantially water-free environment.

In an embodiment of the present invention, a dry reformer feed is charged to a multiple-reactor reforming system operated under reforming conditions. During the charging of the dry reformer feed, a chloriding agent is introduced into the dry reformer feed by sequential injection immediately upstream from the inlets of each of the reformer reactors of the multiple-reactor reformer system, with only one reactor at a time receiving an injection of the chloriding agent.

The multiple-reactor reformer system of the present invention comprises at least two reactors connected in series and fluid-flow communication. The reactors define a reaction zone and contain loads of reformer catalyst. It is preferred for the multiple-reactor reformer system to include more than two reactors, such as an initial reactor, at least one intermediate reactor, and a final reactor, all of which are serially connected in fluid-flow communication.

The reformer reactors employed in practicing the present invention may be any conventional reformer reactor known in the art. Each reformer reactor defines a reaction zone which contains a reformer catalyst, usually provided in the form of a bed of such reformer catalyst. The catalyst bed may be fixed or moving, with fixed being the presently preferred configuration.

The reformer catalyst may be any catalyst capable of reforming a reformable hydrocarbon. Preferably, the reformer catalyst comprises at least one Group VIII metal component and a porous support material. More preferably, the reformer catalyst comprises at least one Group VIII metal component, a halogen component, and a porous support material. Even more preferably, the reformer catalyst is a bimetallic catalyst on a support and further including a halogen component, such as, a reformer catalyst comprising platinum, a metal selected from the group consisting of rhenium, iridium, tin, and germanium, a halogen component, and a refractory inorganic oxide support material. Most preferably, the reformer catalyst comprises, consists of, or consists essentially of platinum, rhenium, chlorine, and an alumina support.

The dry reformer feed charged to the first reformer reactor of the multiple-reactor reformer system comprises reformable hydrocarbons. The reformable hydrocarbons include hydrocarbons comprising naphthenes and paraffins that boil within the gasoline boiling range including, for example, straight-run naphthas, natural gasoline, synthetic naphthas, thermal gasoline, catalytically cracked gasoline, partially reformed naphthas, and raffinates from the extraction of aromatics. Preferably, the reformable hydrocarbons are naphtha comprising paraffins, naphthenes, and aromatics that boil within the gasoline boiling range, for example, within the range of from about 80° F. to about 450° F. It is preferred for the naphtha to comprise about 20 volume percent to about 80 volume percent paraffins, about 10 volume percent to about 70 volume percent naphthenes, and about 2 volume percent to about 30 volume percent aromatics.

It is an important aspect of the present invention for the dry reformer feed being charged to the first reactor of the multiple-reactor reformer system to be substantially water-free. It is preferred for the concentration of water in the dry reformer feed entering the reaction zone to be less than about 50 ppmw (parts per million by weight of the dry reformer feed), more preferably the concentration is less than about 25 ppmw, even more preferably it is less than about 5 ppmw, still more preferably the concentration is less than about 1 ppmw, and most preferably it is less than 0.1 ppmw.

A diluent may be added to the dry reformer feed prior to charging to the first reformer reactor of the multiple-reactor reformer system. Any diluent recognized in the art may be utilized either individually or in admixture with hydrogen. Hydrogen is the presently preferred diluent because it serves the dual function of lowering the partial pressure of the hydrocarbon feed and suppressing the formation of coke on the reformer catalyst. The weight ratio of diluent-to-reformable hydrocarbon is preferably maintained at from about 1:2 to about 20:1, more preferably from about 1:1 to about 10:1, and most preferably from 3:1 to 6:1. It is preferred that the diluent be substantially water-free, with a water concentration of less than about 50 ppmw (parts per million by weight of the diluent), more preferably less than about 5 ppmw, and most preferably less than 1 ppmw.

It is preferred for the dry reformer feed to be hydrotreated before reforming in order to remove impurities such as nitrogen and sulfur. The presence of nitrogen and sulfur in the dry reformer feed can cause accelerated deactivation of the reformer catalyst. Preferably, the amount of nitrogen in the dry reformer feed is maintained at a level less than about 2.0 ppmw (parts per million by weight of the dry reformer feed), more preferably less than about 1.0 ppmw, and most preferably less than 0.5 ppmw. Preferably, the amount of sulfur present in the dry reformer feed is maintained at a level less than about 2.0 ppmw, more preferably less than about 1.0 ppmw, and most preferably less than 0.5 ppmw.

The chloriding agent introduced into the dry reformer feed may be any chlorine-containing compound capable of inhibiting the deactivation of a reformer catalyst when introduced into a dry reformer feed being charged to a reformer reactor. Preferably, the chloriding compound is a nonmetallic compound. More preferably, the chloriding compound is a nonmetallic organic compound. Presently preferred nonmetallic organic chlorides include, for example, hexachloroethane, carbon tetrachloride, 1-chlorobutane, 1-chloro-2-methyl propane, 2-chloro-2-methyl propane, tertiary butyl chloride, propylene dichloride, perchloroethylene and mixtures of two or more thereof. The presently most preferred nonmetallic organic chloride is perchloroethylene (PCE).

The chloriding agent is introduced into the dry reformer feed by sequential injection at points located immediately upstream from the inlets of each of the reformer reactors. As used herein the term "sequential injection" or "sequential introduction" means a method of injecting the chloriding agent into the dry reformer feed of a series of reformer reactors of a multiple-reactor reformer system comprising the following steps: (1) injecting the chloriding agent into the dry reformer feed of one reactor of the series for a specific time period; (2) thereafter, terminating such injection of the chloriding agent into the dry reformer feed of such one reactor of the series; (3) thereafter, injecting the chloriding agent into the dry reformer feed of the next reformer reactor of the series for a specific time period; (4) thereafter, terminating the injection of the chloriding agent into the dry reformer feed of such next reformer reactor of the series; and (5) repeating steps (3) and (4) for all subsequent reformer reactors, if any, of the series. As used herein, the phrase "immediately upstream from the inlet of the reformer reactor" means a location wherein there is no substantial change in the composition of the dry reformer feed and the chloriding agent between the chloriding agent injection point and the inlet of the reformer reactor.

The chloriding agent may be injected in pure form or with a carrier. Preferably, the chloriding agent is injected with a carrier. The carrier may be any compound capable of dissolving the chloriding agent which does not have an adverse material impact on the reforming reaction. The carrier, however, may not be water. Preferably, the carrier is a hydrocarbon. Most preferably, the carrier is a hydrocarbon of substantially the same composition as the reformable hydrocarbons of the dry reformer feed.

The chloriding agent may be injected into the dry reformer feed by any method known in the art. It is preferred for the chloriding agent injection method to result in exposing substantially all the reformer catalyst contained within a given reaction zone to a substantially uniform amount of the chloriding agent. A preferred injection system comprises an additive storage source connected in fluid flow communication with an additive moving means connected in fluid flow communication with an additive flow control means connected in fluid flow communication with an additive injection means. The additive storage source may be any conventional means of storing a quantity of a compound such as the chloriding agent, for example, a storage tank. The additive moving means may be any conventional means of moving a quantity of a compound such as the chloriding agent through a conduit, for example, a pump. The additive flow control means may be any conventional means for controlling the flow of a compound such as the chloriding agent to and among reformer reactors, for example, a valve or valves. The additive injection means may be any conventional means for injecting a compound such as the chloriding agent into a conduit carrying a hydrocarbon feed, for example, a nozzle or quill.

The rate of injection of the chloriding agent into the dry reformer feed may be any rate that is effective to inhibit deactivation of the reformer catalyst. Preferably, the injection rate is a rate sufficient to provide a concentration of the chloriding agent in the dry reformer feed of from more than about 0.05 ppmw (parts per million by weight of the dry reformer feed) to less than about 50 ppmw of the chloriding agent in the dry reformer feed. More preferably, the injection rate provides a concentration of the chloriding agent of from more than about 0.1 ppmw to less than about 10 ppmw in the dry reformer feed. Still more preferably, the injection rate provides a concentration of the chloriding agent of from more than about 0.2 ppmw to less than about 5 ppmw in the dry reformer feed. Most preferably, the injection rate is such as to provide a chloriding agent concentration in the dry reformer feed exceeding 0.5 ppmw but less than 2 ppmw.

The period of continuous injection of the chloriding agent into the dry reformer feed of each reformer reactor may be any suitable period that is effective to inhibit deactivation of the reformer catalyst contained therein. Preferably the period of injection is from about 0.1 hours to about 5,000 hours, more preferably from about 0.5 hour to about 1,000 hours, still more preferably from about 1 hours to about 500 hours, and most preferably from about 4 hours to about 100 hours.

The reforming conditions employed in the practice of the present invention may be any conditions necessary to effectively convert the dry reformer feed into a product of higher octane number. Octane number, as defined by ASTM D2699 for research octane number and ASTM D2700 for motor octane number, is an indication of a fuel's resistance to pre-ignition during the compression stroke of a piston.

The temperature required for reforming varies according to numerous reaction parameters, including, for example, feed composition, catalyst composition, reaction pressure, diluent-to-hydrocarbon ratio, and the amount of coke on the reformer catalyst. Generally, the temperature required for reforming is in the range of from about 800° F. to about 1100° F. Ordinarily, the temperature is slowly increased during the reforming process to compensate for deactivation of the catalyst and to provide a product of a desired octane number.

The reforming reaction pressures are in the range of from about 0 psig to about 600 psig, preferably from about 15 psig to about 400 psig, and most preferably from 50 psig to 350 psig.

The liquid-volume hourly velocity (LHSV) of the dry reformer feed to the reformer reactor is in the range of from about 0.1 to about 100 $hours^{-1}$. The preferred LHSV of the dry reformer feed can be in the range of from about 0.25 to about 25 $hours^{-1}$.

To achieve the benefits of the present invention, it is essential for the chloriding agent to be sequentially introduced immediately upstream from the inlets of each of the reformer reactors while charging the multiple-reactor reformer system with a dry reformer feed. This sequential introduction of the chloriding agent solves some of the recently discovered problems associated with the introduction of the chloriding agent only in the first reactor of the reactor series while charging the system with a dry reformer feed. It is important for the reformer charge to be dry so as to prevent, or at least reduce, the coking of the reformer catalyst and the stripping of the chloride component from the reformer catalyst. It also appears, unexpectedly, that dry conditions in the reaction zone of a reformer reactor result in improved catalyst activity.

It is thus desirable to react a reformer feedstock in a dry environment; however, to exploit the advantages of chloriding a reformer catalyst during operation of a multiple-reactor reformer system, conventional methods generally used water to aid in carrying the chloriding agent through the serially arranged reformer reactors of a multiple-reactor reformer system. As noted, however, the presence of water in the reaction zones of the reformer reactors is not desired. By sequentially introducing the chloriding agent immediately upstream from the inlets of each of the serially connected reformer reactors without the simultaneous introduction of water, the reformer catalyst contained in both the upstream and the downstream reactors of the multiple-reactor reformer system is treated with a desired amount of the chloriding agent. This method allows for the processing of a dry reformer feed.

Referring now to FIG. 1 in which is provided a schematic representation of a multiple-reactor reformer system 10. A substantially water-free hydrocarbon feed is charged to multiple-reactor reformer system 10 via a conduit 12. The substantially water-free hydrocarbon feed passes through a first heater 14 which heats the substantially water-free hydrocarbon feed to a preferred reformer reaction temperature prior to charging the substantially water-free hydrocarbon feed to a first reactor 16.

First reactor 16 defines a first volume 18 containing a first catalyst 20. First reactor 16 is equipped with a first inlet 22 for receiving the heated substantially water-free hydrocarbon feed through a first conduit 24, which is operatively connected to first inlet 22 and used for conveying the heated substantially water-free hydrocarbon feed from first heater 14. First reactor 16 is also equipped with a first outlet 26 for discharging a first effluent from first reactor 16.

The first effluent from first reactor 16 passes by way of a second conduit 28 to a second reactor 30. Second reactor 30 is equipped with a second inlet 32 for receiving the first effluent and a second outlet 34 for discharging a second effluent from second reactor 30. Second reactor 30 defines a second volume 36 containing a second catalyst 40. Second conduit 28 is operatively connected to first outlet 26 and second inlet 32 and provides for fluid-flow communication between first reactor 16 and second reactor 30. Interposed in second conduit 28 is a second heater 42 which provides for the introduction of heat energy into the first effluent. The need for introducing heat into the first effluent results from the endothermic nature of reforming reactions taking place in first reactor 16.

The second effluent from second reactor 30 passes by way of a third conduit 44 to a third reactor 46. Third reactor 46 is equipped with a third inlet 48, for receiving the second effluent from second reactor 30 and a third outlet 50 for discharging third effluent from third reactor 46. Third reactor 46 defines a third volume 32 containing a third catalyst 54. Third conduit 44 is operatively connected to second outlet 34 and third inlet 48 and provides for fluid-flow communication between second reactor 30 and third reactor 46. Interposed in third conduit 44 is a third heater 56 which provides for the introduction of heat energy into second effluent, required as a result of the endothermic reforming reactions taking place in second reactor 30.

A fourth conduit 58 is operatively connected to third outlet 50 and to a phase separator 60 and provides means for conveying the third effluent from third reactor 46 to phase separator 60. Interposed in third conduit 58 is a cooler 62 which provides for the condensation of liquids of the third effluent. Phase separator 60 provides for the separation of lighter gaseous components and heavier liquid components. The separated heavier liquid component is the fluid reformate product and passes from phase separator 60 and the multiple-reactor reformer system 10 by way of a conduit 64. The separated gaseous components are recycled through a conduit 66 back to and are combined with the substantially water-free hydrocarbon feed passing to multiple-reactor reformer system 10 through conduit 12. Interposed in conduit 66 is a compressor 68 which provides for the conveyance and recycling of the separated gaseous components.

A chloriding agent is introduced into the multiple-reactor reformer system 10 through a conduit 70. By passing through a conduit 72, the chloriding agent is introduced into first conduit 24 at a rate which provides a concentration of the chloriding agent in the substantially water-free hydrocarbon feed sufficient to inhibit the deactivation rate of first catalyst 20. Typically, such concentration should be in the range of from about 0.05 ppmw to about 50 ppmw, more preferably, from about 0.1 ppmw to about 10 ppmw, still more preferably, the concentration can be in the range of from about 0.2 ppmw to about 5 ppmw and, most preferably, from 0.5 ppmw to 2 ppmw. The chloriding agent is continuously introduced into first conduit 24 for a first time period that is effective to inhibit the deactivation rate of first catalyst 20. The first time period is preferably from about 0.1 hours to about 5,000 hours, more preferably from about 0.5 hour to about 1,000 hours, still more preferably from about 1 hours to about 500 hours, and most preferably from about 4 hours to about 100 hours. At the end of the first time period, the injection of the chloriding agent into first conduit 24 is terminated.

After terminating the introduction of the chloriding agent into first conduit 24, the chloriding agent is introduced by way of a conduit 74 into second conduit 28 at a rate which provides a concentration of chloriding agent in the first effluent that is sufficient to inhibit the deactivation rate of second catalyst 40. Typically, such concentration should be in the range of from about 0.05 ppmw to about 50 ppmw, more preferably, from about 0.1 ppmw to about 10 ppmw, still more preferably, the concentration can be in the range of from about 0.2 ppmw to about 5 ppmw and, most preferably, from 0.5 ppmw to 2 ppmw. The chloriding agent is continuously introduced into second conduit 28 for a second time period that is effective to inhibit the deactivation rate of second catalyst 40. The second time period is preferably from about 0.1 hours to about 5,000 hours, more preferably from about 0.5 hour to about 1,000 hours, still more preferably from about 1 hours to about 500 hours, and most preferably from about 4 hours to about 100 hours. At the end of the second time period, the injection of the chloriding agent into second conduit 28 is terminated.

After terminating the introduction of the chloriding agent into second conduit 28, the chloriding agent is introduced into third conduit 44 at a rate which provides a concentration of chloriding agent in the second effluent sufficient to inhibit the deactivation rate of third catalyst 54. Typically, such concentration should be in the range of from about 0.05 ppmw to about 50 ppmw, more preferably, from about 0.1 ppmw to about 10 ppmw, still more preferably, the concentration can be in the range of from about 0.2 ppmw to about 5 ppmw and, most preferably, from 0.5 ppmw to 2 ppmw. The chloriding agent is continuously introduced into third conduit 44 for a third time period that is effective to inhibit the deactivation rate of second catalyst 54. The third time period is preferably from about 0.1 hours to about 5,000 hours, more preferably from about 0.5 hour to about 1,000 hours, still more preferably from about 1 hours to about 500 hours, and most preferably from about 4 hours to about 100 hours. At the end of the third time period, the injection of the chloriding agent into third conduit 44 is terminated.

It is important to the effectiveness of this invention for the concentration of water in the charge stock to each of the reactors of the multiple-reactor reformer system 10 to be dry and, preferably, substantially dry or water-free. Both the feedstock to multiple-reactor reformer system 10 and the chloriding agent must be as free of water as possible. Thus, it is critical for the chloriding agent to be introduced without the conventional simultaneous introduction of water and for the feedstock to multiple-reactor reformer system 10 to be dry and, preferably substantially dry. Preferably the water concentration in the chloriding agent is less than about 50 ppmw, more preferably less than about 5 ppmw, and most preferably less than 1 ppmw. It is preferred for the concentration of water in the dry reformer feed entering multiple-reactor reformer system 10 to be less than about 50 ppmw, more preferably the concentration is less than about 25 ppmw, even more preferably it is less than about 5 ppmw, still more preferably the concentration is less than about 1 ppmw, and most preferably it is less than 0.1 ppmw.

The following examples are presented to further illustrate the invention and are not considered as limiting the scope of the invention.

EXAMPLE I (Control)

This example demonstrates the amount of coke which accumulates on a reformer catalyst during a conventional reforming process at a commercial refinery.

The data in Table I was obtained from catalyst samples extracted from the fourth reactor of a commercial four-reactor reformer system at specified points in the reforming cycle. The reformer feed was naphtha comprising reformable hydrocarbons, 99% of which boiled in the range of 140° F. to 365° F. The naphtha feed comprised about 51% paraffins, about 32% naphthenes, and about 17% aromatics, and contained about 20 ppmw water. The reaction conditions of reactor 4 included a temperature of approximately 950° F., a pressure of 320 psig, a diluent-to-hydrocarbon ratio of about 4.5, and a relatively constant product RON of about 94. In accordance with conventional reforming practice, a perchloroethylene (PCE) chloriding agent was injected, with water, during reforming into the reformer feed upstream from reactor 1.

The catalyst samples extracted from reactor 4 were analyzed to determine the weight % of coke on the catalyst. Analysis was performed by a standard CHNS (carbon, hydrogen, nitrogen, sulfur) analysis wherein the catalyst samples were combusted at high temperatures and the amount of $CO_2$, $H_2O$, $NO_2$ and $SO_3$ in the combusted products was measured.

Table I demonstrates that in a conventional reforming process using PCE/water injection upstream from reactor 1, the weight percent of coke on reforming catalyst in reactor 4 increases over time as more barrels are processed.

TABLE I

Conventional Reforming Process
Wt. % Coke on Catalyst in Reactor 4

| BBL Processed | Wt. % Coke |
|---|---|
| 2000 | .7 |
| 2,662,600 | 16.7 |

EXAMPLE II (Invention)

This example demonstrates that the present invention counteracts the formation of coke on a reformer catalyst.

The reformer feed, reformer system, reaction parameters, and test procedures employed in this example are the same as Example I, however, in this example PCE was injected sequentially during reforming at each of the four reactors without introducing water simultaneously therewith.

PCE was injected, without water, according to a continuous weekly rotating injection cycle, with injection occurring in only one reactor at a time. The weekly injection cycle included the injection of 0.5 ppmw PCE into the feedstream of only reactor 1 for a period of 24 hours, immediately followed by the injection of 0.5 ppmw PCE into the feedstream of only reactor 2 for 24 hours, immediately followed by the injection of 0.5 ppmw PCE into the feedstream of only reactor 3 for 48 hours, immediately followed by the injection of 0.5 ppmw PCE into the feedstream of only reactor 4 for a period of 72 hours. Immediately after injection of PCE at reactor 4 was terminated, the injection cycle was repeated, starting over with reactor 1.

Figure 2:
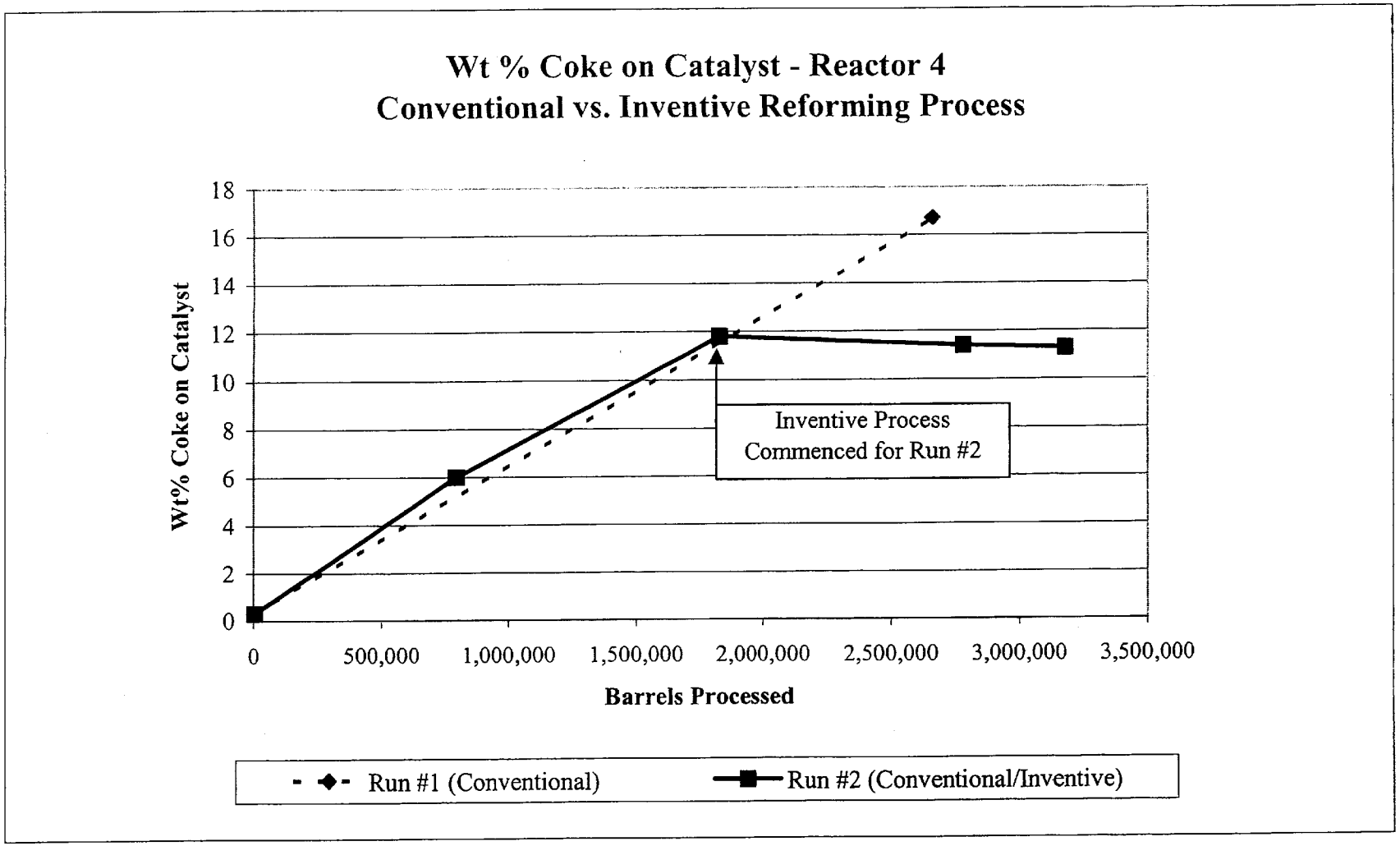
FIG. 2 is a chart comparing weight percent coke formed on the reforming catalyst as a function of volume of feed processed for a conventional reforming process and for the inventive reforming process.

Table II and FIG. 2 compare the weight percent coke on catalyst in reactor 4 for the conventional and the inventive reforming processes. FIG. 2 shows that the rate of coke formation on the catalyst were approximately the same for Run #1 and Run #2 prior to commencing the inventive PCE injection. After the Run #2 data point at 1,828,040 bb1 was taken, the inventive PCE injection was commenced. The Run #2 data points occurring after commencement of the inventive PCE injection demonstrate not only a diminished buildup of coke on the catalyst, but also an eliminated buildup of coke on the catalyst, and even a totally unexpected decline of coke on the catalyst.

TABLE II

Conventional vs. Inventive Reforming Process
Wt. % Coke on Catalyst in Reactor 4

| BBL Processed | Run #1 Conventional *Wt. % Coke | Run #2 Conventional/Invention Wt. % Coke |
|---|---|---|
| 2,000 | 0.7 | — |
| 3,800 | — | 0.3 |
| 794,800 | — | 6.0 |
| 1,828,400 | — | 11.8* |
| 2,662,600 | 16.7 | — |
| 2,781,800 | — | 11.4** |
| 3,179,200 | — | 11.3** |

*Inventive PCE injection commenced.
**Inventive PCE injection continued.

EXAMPLE III (Control)

This example demonstrates the amount of coke which accumulates on a reformer catalyst located in each reactor of a 3-reactor commercial reformer system during conventional reforming.

The data in Table III was obtained during a "carbon burn-off" of a deactivated reformer catalyst in a commercial 3-reactor reformer system. Prior to the carbon burn-off, the system was operated in accordance with standard commercial practice, with a PCE chloriding agent being injected, with water, during reforming into the reformer feed upstream from reactor 1. The reformer feed was naphtha comprising reformable hydrocarbons, 99% of which boiled in the range of 240° F. to 365° F. The naphtha feed comprised about 50% paraffins, about 36% naphthenes, and about 24% aromatics, and contained about 20 ppmw water. The reaction conditions in each of the 3 reactors of the reformer system included a temperature of approximately 950° F., a pressure of approximately 320 psig, a diluent-to-hydrocarbon ratio of approximately about 4.5, and a relatively constant product RON of about 94.

In accordance with standard procedures for the regeneration of a deactivated reformer catalyst, the reformer system was shut down and a high-temperature carbon burn-off procedure was commenced. During the carbon burn-off procedure, each of the 3 reactors of the system was charged with a feed consisting of approximately 95% nitrogen and approximately 5% oxygen. At the beginning of the carbon burn-off procedure the temperature in each reactor was maintained at approximately 900° F., however, as the nitrogen/oxygen feed was charged to each reactor the temperature in the reactor increased due to the burning of coke deposits on the catalyst. During carbon burn-off, the temperature in each reactor increased over time as an increasing amount of coke on the catalyst was burned. Once a substantial amount of carbon was burned off of the catalyst, the temperature in each reactor began to decline as less and less coke was present on the catalyst.

Figure 3:
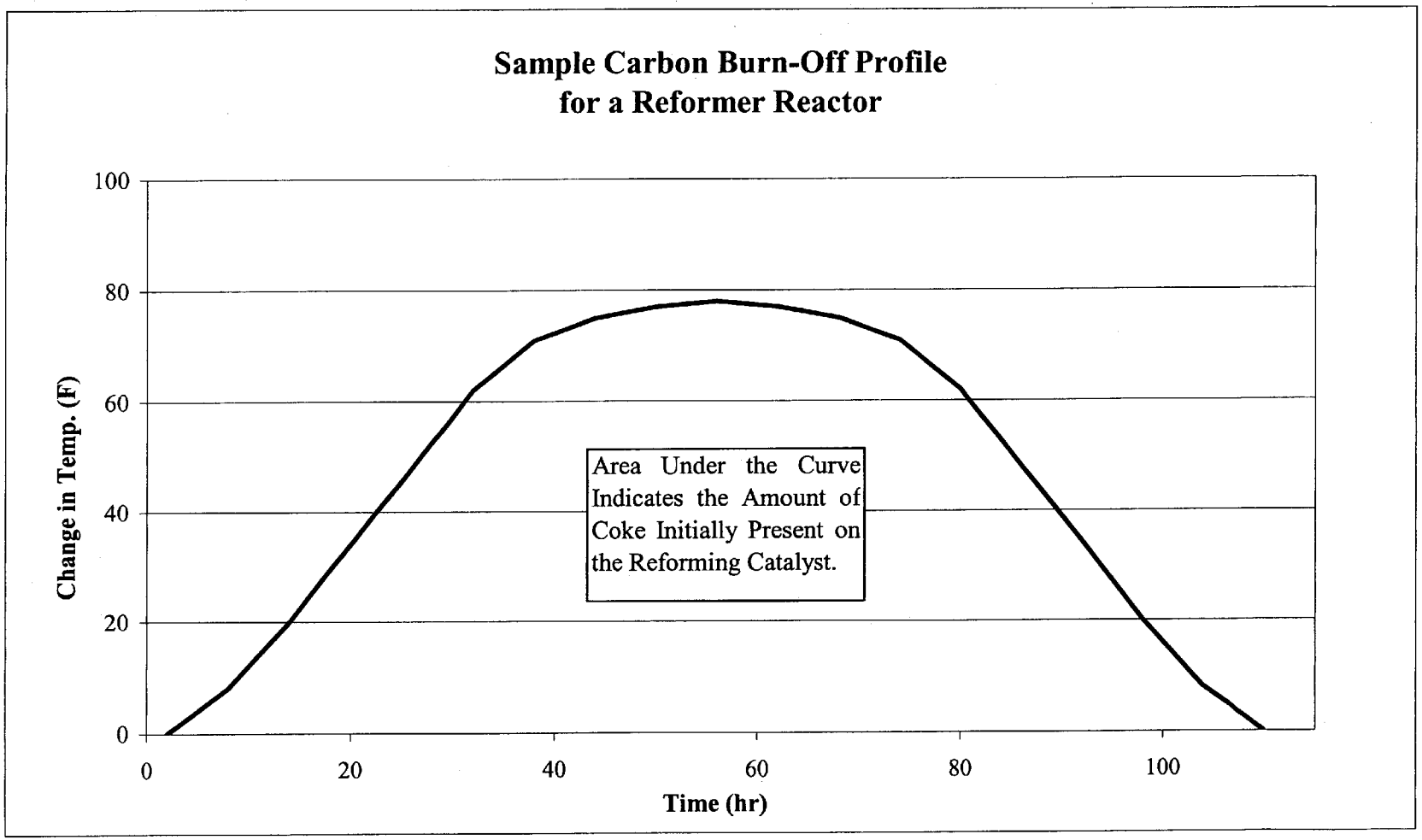
FIG. 3 is a chart plotting change in temperature over time for a typical catalyst carbon burn-off procedure, which may be used to determined the quantity of coke present on the catalyst.

FIG. 3 plots of the change in reactor temperature versus time during a typical carbon burn-off process. Because the change in temperature (ΔT) and time of a typical carbon burn-off process are directly related to the amount of coke deposits on the original deactivated catalyst, a useful measure of the amount of coke contained on the deactivated catalyst can be obtained by calculating the area under the ΔT versus time curve of a carbon burn-off. Although the value determined by calculating the area under the ΔT versus time curve of a carbon burn-off procedure does not yield an actual weight percent of coke present on the reformer catalyst, it is very useful for comparing the relative amount of coke on catalysts in different reactors and different runs.

Table III presents carbon burn-off data for each reactor of the 3-reactor system, wherein the reformer system was operated according to conventional commercial practices prior to the carbon burn-off, with PCE and water being injected upstream from reactor 1. The data presented in column 1 of Table III are calculated values of the area under the carbon burn-off profile, expressed in units of degree(F.) *hours. The first column of data in Table III presents absolute coke amounts for each of the three reactors. However, because the three reactors of the reformer system tested were not the same size these values were adjusted for reactor size in order to yield values suitable for accurate comparison. The amount of catalyst in each reactor was directly proportional to the reactor volumes. Reactor 1 accounted for 20% of the total system volume, reactor 2 accounted for 30% of the total system volume, and reactor 3 accounted for 50% of the total system volume. Column 2 of Table III presents the relative coking values which were adjusted for reactor size in order to properly compare the amount of coke on the catalyst in each reactor.

Table III demonstrates that coke tends to form on the catalyst contained in the final reactors of the reformer system at an accelerated rate. The amount of coke contained on the catalyst in reactor 2 was approximately twice the amount of coke contained on the catalyst in reactor 1, while the amount of coke on the catalyst contained in reactor 3 was nearly three times the amount of coke contained on the catalyst in reactor 1.

TABLE III

Conventional Reforming Process Coking in Bach Reactor

| | Absolute Area Under Carbon Burn-Off Profile (° F. hr) | Relative Amount of Coke on Catalyst |
|---|---|---|
| Reactor 1 | 200 | 40 |
| Reactor 2 | 600 | 80 |
| Reactor 3 | 1,400 | 112 |

EXAMPLE IV (Invention)

This examples demonstrates that the present invention counteracts the accelerated rate of coke formation on a reformer catalyst which is typically experienced in the final reactor or reactors of a reformer system.

The reformer feed, reformer system, reaction parameters, and test procedures employed in this example are the same as Example II, however, in this example PCE was injected sequentially during reforming at each of the three reactors without introducing water simultaneously therewith.

During reforming, PCE was injected, without water, according to a continuous daily rotating injection cycle, with injection occurring in only one reactor at a time. The daily injection cycle included the injection of 1.0 ppmw PCE into the feedstream of only reactor 1 for a period of 8 hours, immediately followed by the injection of 1 ppmw PCE into the feedstream of only reactor 2 for 8 hours, immediately followed by the injection of 1 ppmw PCE into the feedstream of only reactor 3 for 16 hours. Immediately after injection of PCE into reactor 3 was terminated, the injection cycle was repeated, starting over with reactor 1.

Figure 4:
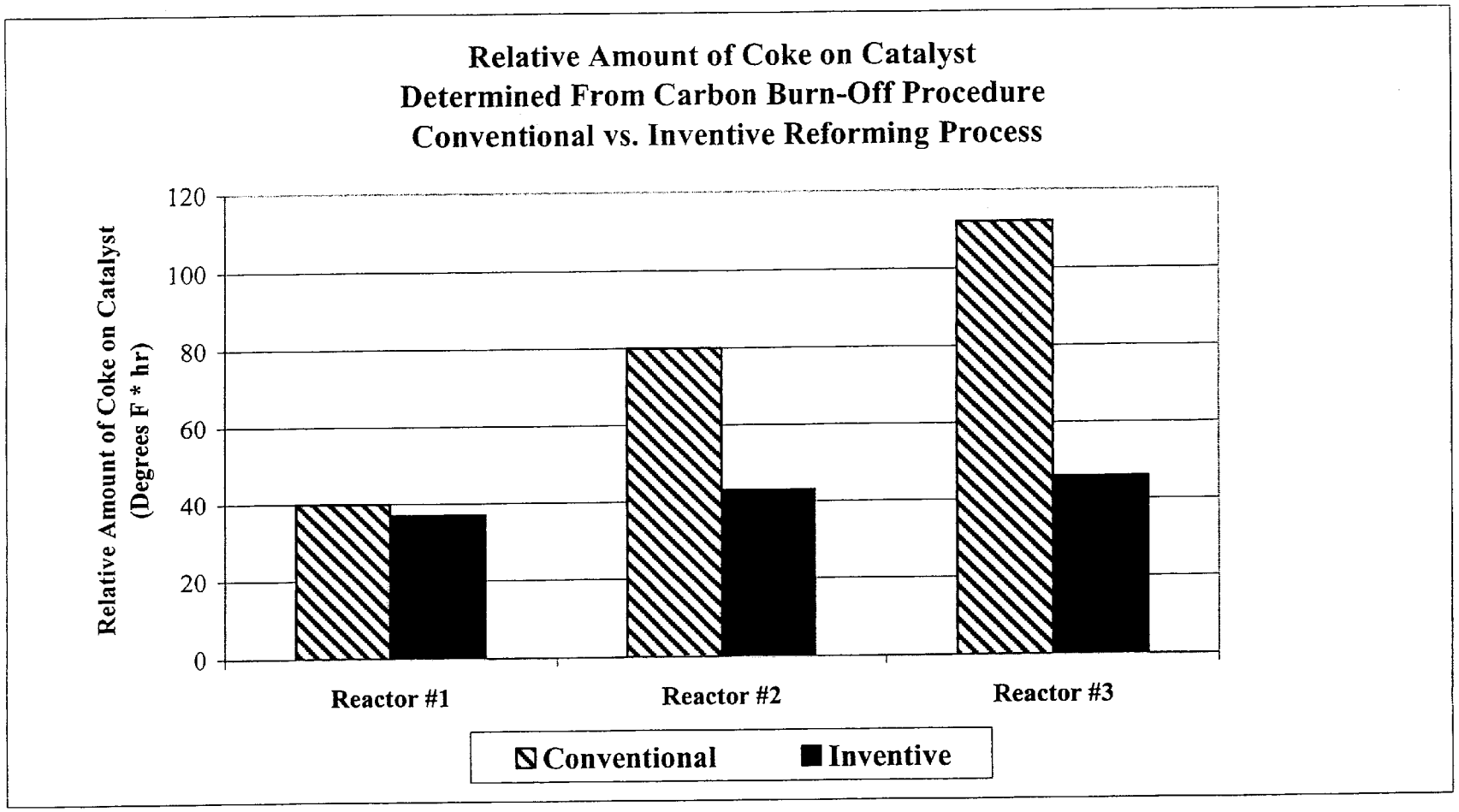
FIG. 4 is a chart presenting the comparative numbers of coke on the reformer catalyst in each of the reactors of a three reactor system for a conventional reforming process and for the inventive reforming process.

Table IV and FIG. 4 compare the amount of coke present on the catalyst of each reactor in the 3-reactor series for the conventional and the inventive reforming processes. The data in Table IV was obtained by calculating the area under the carbon burn-off profile and adjusting for reactor size, as described in Example III.

Table IV and FIG. 4 demonstrate that the present invention counteracts the accelerated rate of coke formation in the second and third reactors of the series. While the rate of coke formation in the second reactor was approximately twice the rate of the first reactor for the conventional reforming process, the rate of coke formation in the second reactor of the present invention is only approximately 15% greater than the rate of formation in the first reactor. In addition, the rate of coke formation in the third reactor using the conventional process was approximately three times the rate of coke formation in the first reactor, while the rate of coke formation in the third reactor using the inventive process is only approximately 25% greater than the rate of coke formation in the first reactor.

TABLE IV

Conventional vs. Inventive Reforming Process

| | Conventional Process Relative Amount of Coke on Catalyst | Inventive Process Relative Amount of Coke on Catalyst |
|---|---|---|
| Reactor 1 | 40 | 37 |
| Reactor 2 | 80 | 43 |
| Reactor 3 | 112 | 46 |

EXAMPLE V (Conventional)

This example demonstrates the activity and catalyst life of a reformer catalyst during a conventional reforming process at a commercial refinery.

The reforming unit was a 4-reactor, semi-regenerative, commercial catalytic reforming unit. The reformer feed composition and reforming conditions employed during the convention reforming process of this example are summarized in Table V. The boiling end point for the reformer feed ranged from 349° F. to 398° F.

TABLE V

| | Conventional Reforming Process | | | | | | |
|---|---|---|---|---|---|---|---|
| | Feed Composition | | | Reaction Conditions | | | |
| | Paraffins (wt. %) | Naphthenes (wt. %) | Aromatics (wt. %) | WAIT (° F.) | Pressure (psig) | $H_2$:HC (molar ratio) | LHSV ($h^{-1}$) |
| Range | 27–60 | 23–38 | 17–35 | 925–975 | 420–460 | 3–5 | 1.4–20 |
| Average | 50.0 | 30.0 | 20.0 | 950 | 440 | 4.1 | 1.8 |

TABLE VI

| | Inventive Reforming Process | | | | | | |
|---|---|---|---|---|---|---|---|
| | Feed Composition | | | Reaction Conditions | | | |
| | Paraffins (wt. %) | Naphthenes (wt. %) | Aromatics (wt. %) | WAIT (° F.) | Pressure (psig) | $H_2$:HC (molar ratio) | LHSV ($h^{-1}$) |
| Range | 51–54 | 30–31 | 16–18 | 927–963 | 420–470 | 3–5 | 1.5–2.0 |
| Average | 52.2 | 30.0 | 17.8 | 945 | 440 | 4#5 | 1.9 |

In accordance with conventional reforming practice, during reforming, about 1 ppmw of perchloroethylene (PCE) was continuously injected into the reformer feed upstream from reactor 1. Methanol was also injected upstream from reactor 1 in an amount which added 3–9 ppmw of water to the reformer feed, thereby providing a reformer feed containing about 5–14 ppmw water.

Figure 5:
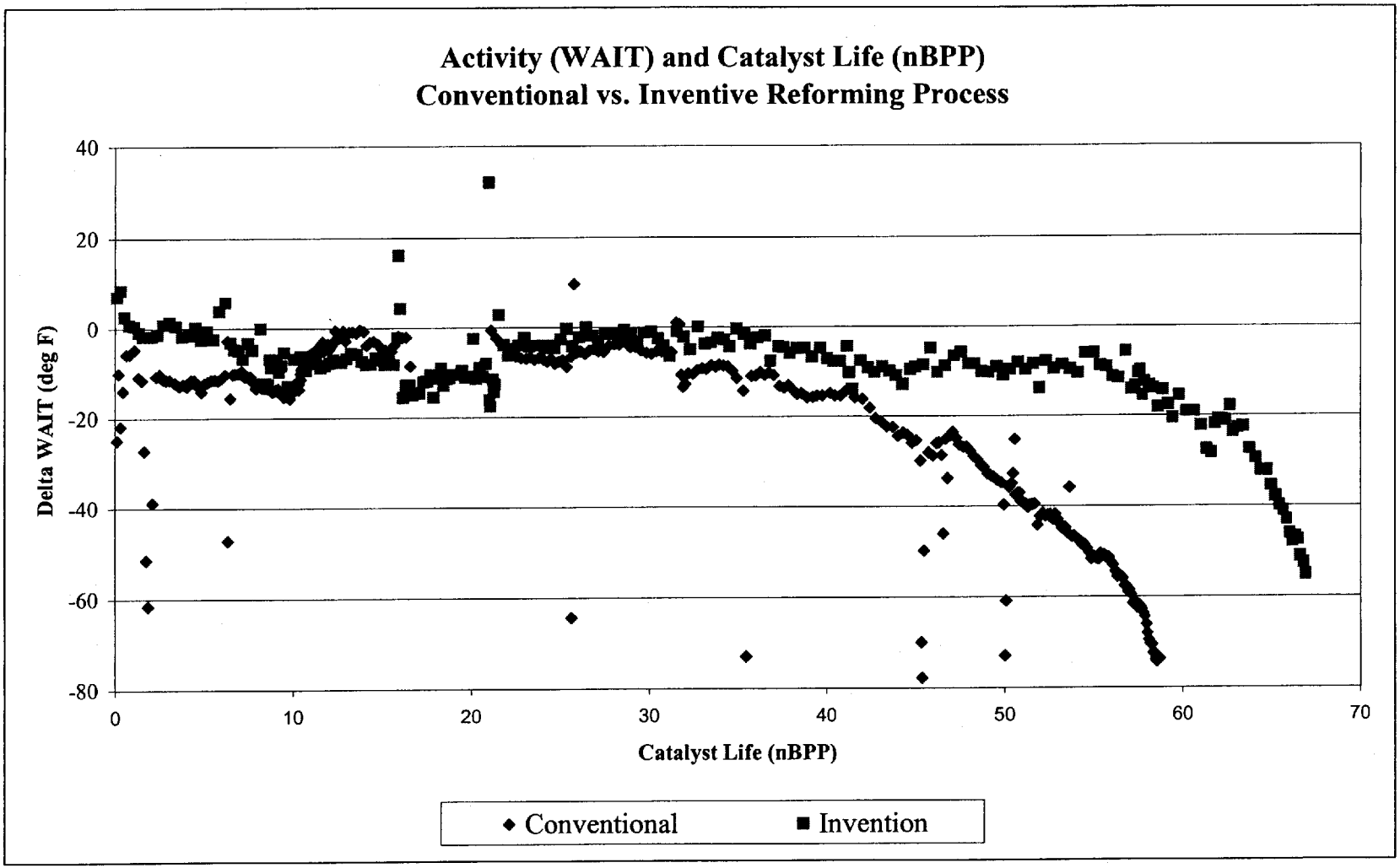
FIG. 5 is a chart comparing ΔWAIT as a function of normalized barrels per pound of catalyst (nBPP) for a conventional reforming process and the inventive reforming process.

During a 330 day run, operating data were gathered and averaged on a daily basis. FIG. 5 plots catalyst activity (ΔWAIT) versus catalyst life (nBPP) using the data accumulated from the conventional reforming process of the present example.

ΔWAIT (weighted average inlet temperature) is a well-know measure of catalyst activity. ΔWAIT is the difference between the actual WAIT and the theoretical WAIT it takes to reform a specific hydrocarbon stream at specific conditions to yield a product of a specific octane number. Actual WAIT is a measured value, while theoretical WAIT is calculated as a function of product RON, feed quality, residence time, and type of catalyst.

Barrels per pound of catalyst (BPP) is a common measure of catalyst life which, unlike measuring catalyst life based on units of time, corrects for fluctuations in hydrocarbon flow during a reforming cycle. However, hydrocarbon flow rate is not the only fluctuating factor that affects the deactivation of a reformer catalyst. Feed end point, feed quality, reaction pressure, hydrogen to hydrocarbon ratio, and product RON also affect the deactivation of a reformer catalyst.

In order to account for fluctuations in these various deactivation factors during the reforming cycle, a cumulative deactivation factor was calculated. The cumulative deactivation factor was an expression correcting feed end point, feed quality, reaction pressure, hydrogen to hydrocarbon ratio, and product RON to set reference conditions. The cumulative deactivation factor for each day was multiplied by the BPP for that day to obtain nBPP. By normalizing the measure of catalyst life to correct for deactivation factors, catalyst activity for reforming cycles of different lengths and fluctuating operating parameters could be accurately compared.

EXAMPLE VI (Invention)

This example demonstrates that the present invention increases the activity and prolongs the life of a reformer catalyst.

The reforming unit employed in this example was the same as Example V. The reformer feed composition and reforming conditions employed during the inventive reforming process of this example are described in Table VI. The boiling end point for the reformer feed ranged from 342° F. to 404° F., and the water content of the feed ranged from 2 to 5 ppmw.

The reforming unit was operated and data collected in substantially the same manner as described in Example V. However, data were gathered over a 242 day period during which PCE was injected sequentially at each of the four reactors without adding water to the feed. PCE was injected according to a rotating injection cycle, with an injection occurring in only one reactor at a time. The injection cycle included the injection of about 1 ppmw PCE into the feedstream of only reactor 1 for a period of about 36 hours, immediately followed by the injection of about 1 ppmw PCE into the feedstream of only reactor 2 for about 36 hours, immediately followed by the injection of about 1 ppmw PCE into the feedstream of only reactor 3 for about 36 hours, immediately followed by the injection of about 1 ppmw PCE into the feedstream of only reactor 4 for a period of about 60 hours. Immediately after the injection of PCE at reactor 4 was terminated, the injection cycle was repeated, starting over with reactor 1.

The data gathered were normalized, as described in Example V, and plotted in FIG. 5.

FIG. 5 plots catalyst activity (ΔWAIT) versus catalyst life (nBPP) for the conventional process of Example V and the inventive process of Example VI. FIG. 5 demonstrates that the inventive reforming process provides a higher catalyst activity and a longer catalyst life than the conventional reforming process.

While this invention has been described in detail for the purpose of illustration, it should not be construed as limited thereby but intended to cover all changes and modifications within the spirit and scope thereof.

That which is claimed is:

1. An improved reforming process whereby deactivation of a reformer catalyst is inhibited, said process comprises the steps of:

charging a substantially water-free and substantially chlorine containing compound-free hydrocarbon feed comprising a reformable hydrocarbon to a reformer system operated under reforming conditions, wherein said reformer system comprises at least two reactors serially connected in fluid-flow communication, and wherein each of said at least two reactors contains said reformer catalyst; and during the charging step, introducing into said substantially water-free and substantially chlorine containing compound-free hydrocarbon feed, immediately upstream from the inlets of each of said at least two reactors, a chloriding agent in an amount and for a period of time that are effective to inhibit the deactivation of said reformer catalyst, wherein said chloriding agent is introduced into said substantially water-free and substantially chlorine containing compound-free hydrocarbon feed without simultaneously introducing water into said substantially water-free and substantially chlorine containing compound-free hydrocarbon feed, and wherein said chloriding agent is sequentially introduced immediately upstream from the inlets of each of said at least two reactors with only one reactor at a time receiving an introduction of said chloriding agent.

2. An improved reforming process according to claim 1 wherein the amount of said chloriding agent introduced into said substantially water-free and substantially chlorine containing compound-free hydrocarbon feed is so as to provide a concentration of said chloriding agent in said substantially water-free and substantially chlorine containing compound-free hydrocarbon feed of from about 0.5 ppmw to about 2 ppmw.

3. An improved reforming process according to claim 2 wherein said substantially water-free hydrocarbon feed contains less than about 5 ppmw of water.

4. A reforming process according to claim 3 wherein said chloriding agent is a nonmetallic organic chloride.

5. A reforming process according to claim 4 wherein said reformer catalyst comprises platinum and alumina.

6. An improved reforming process according to claim 1 wherein the amount of said chloriding agent introduced into said substantially water-free hydrocarbon feed is so as to provide a concentration of said chloriding agent in said substantially water-free hydrocarbon feed of from about 0.2 ppmw to about 5 ppmw.

7. An improved reforming process according to claim 1 wherein said substantially water-free and substantially chlorine containing compound-free hydrocarbon feed contains less than about 1 ppmw of water.

8. A reforming process according to claim 7 wherein said chloriding agent is perchloroethylene.

9. A reforming process according to claim 8 wherein said reformer catalyst comprises platinum, rhenium, chlorine and alumina.

10. An improved reforming process whereby deactivation of a reformer catalyst is inhibited, said process comprises the steps of:

charging a substantially water-free and substantially chlorine containing compound-free hydrocarbon feed to a reformer system operated under reforming conditions, said reformer system comprising an initial reactor, at least one intermediate reactor, and a final reactor serially connected in fluid-flow communication, wherein each of said initial reactor, said at least one intermediate reactor, and said final reactor contain said reformer catalyst; and during the charging step, introducing into said substantially water-free and substantially chlorine containing compound-free hydrocarbon feed, immediately upstream from the inlets of said initial reactor, said at least one intermediate reactor, and said final reactor, a chloriding agent in an amount and for a period of time that are effective to inhibit the deactivation of said reformer catalyst, wherein said chloriding agent is introduced into said substantially water-free and substantially chlorine containing compound-free hydrocarbon feed without simultaneously introducing water into said substantially water-free and substantially chlorine containing compound-free hydrocarbon feed, and wherein said chloriding agent is sequentially introduced immediately upstream from the inlets of said initial reactor, said at least one intermediate reactor, and said final reactor with only one of said initial reactor, said at least one intermediate reactor, and said final reactor receiving an introduction of said chloriding agent at one time.

11. An improved reforming process according to claim 10 wherein the amount of said chloriding agent introduced into said substantially water-free and substantially chlorine containing compound-free hydrocarbon feed is so as to provide a concentration of said chloriding agent in said substantially water-free and substantially chlorine containing compound-free hydrocarbon feed of from about 0.5 ppmw to about 2 ppmw.

12. An improved reforming process according to claim 11 wherein said substantially water-free hydrocarbon feed contains less than about 5 ppmw of water.

13. A reforming process according to claim 12 wherein said chloriding agent is a nonmetallic organic chloride.

14. A reforming process according to claim 13 wherein said reformer catalyst comprises platinum and alumina.

15. An improved reforming process according to claim 10 wherein the amount of said chloriding agent introduced into said substantially water-free hydrocarbon feed is so as to provide a concentration of said chloriding agent in said substantially water-free hydrocarbon feed of from about 0.2 ppmw to about 5 ppmw.

16. An improved reforming process according to claim 10 wherein said substantially water-free and substantially chlorine containing compound-free hydrocarbon feed contains less than about 1 ppmw of water.

17. A reforming process according to claim 16 wherein said chloriding agent is perchloroethylene.

18. A reforming process according to claim 17 wherein said reformer catalyst comprises platinum, rhenium, chlorine and alumina.

19. A method of operating a reformer system comprising a first reactor having a first inlet for receiving a feed and a first outlet for discharging a first effluent said first reactor defines a first volume containing a first catalyst, a second reactor having a second inlet for receiving said first effluent and a second outlet for discharging a second effluent, said second reactor defines a second volume containing a second catalyst, a third reactor having a third inlet for receiving said second effluent and a third outlet for discharging a third effluent, said third reactor defines a third volume containing a third catalyst, a first conduit means, operatively connected to said first inlet, for conveying said feed to said first reactor, a second conduit means, operatively connected to said first outlet and said second inlet, providing fluid-flow communication between said first reactor and said second reactor and for conveying said first effluent from said first reactor to said second reactor, a third conduit means, operatively connected to said second outlet and said third inlet, providing fluid-flow communication between said second reactor and said third reactor and for conveying said second effluent from said second reactor to said third reactor, a fourth conduit means, operatively connected to said third outlet, for conveying said third effluent from said third reactor, said method comprising the steps of:

a) charging a substantially water-free and substantially chlorine containing compound-free hydrocarbon feed comprising a reformable hydrocarbon to said reformer system operated under reforming conditions through said first conduit means;

b) during the charging step a), introducing into said first conduit means, without the simultaneous introduction of water, a chloriding agent in an amount sufficient to provide a concentration of said chloriding agent in said substantially water-free and substantially chlorine containing compound-free hydrocarbon feed in the range of from about 0.1 ppmw to about 10 ppmw;

c) after step b), and during the charging step a), terminating the introduction of said chloriding agent into said first conduit means;

d) after step c), and during the charging step a), introducing into said second conduit means, without the simultaneous introduction of water, a chloriding agent in an amount sufficient to provide a concentration of said chloriding agent in said first effluent in the range of from about 0.1 ppmw to about 10 ppmw;

e) after step d), and during the charging step a), terminating the introduction of said chloriding agent into said second conduit means;

f) after step e), and during the charging step a), introducing into said third conduit means, without the simultaneous introduction of water, a chloriding agent in an amount sufficient to provide a concentration of said chloriding agent in said second effluent in the range of from about 0.1 ppmw to about 10 ppmw; and g) after step f), and during the charging step a), terminating the introduction of said chloriding agent into said third conduit means.

20. An improved reforming process according to claim 19 wherein said substantially water-free hydrocarbon feed contains less than about 5 ppmw of water.

21. A reforming process according to claim 20 wherein said chloriding agent is a nonmetallic organic chloride.

22. A reforming process according to claim 21 wherein said reformer catalyst comprises platinum and alumina.

23. An improved reforming process according to claim 19 wherein the amount of said chloriding agent introduced into said first conduit means, said second conduit means, and said third conduit means is so as to provide a concentration of said chloriding agent in said substantially water-free hydrocarbon feed of from about 0.2 ppmw to about 5 ppmw.

24. An improved reforming process according to claim 23 wherein said substantially water-free hydrocarbon feed contains less than about 1 ppmw of water.

25. A reforming process according to claim 24 wherein said chloriding agent is perchloroethylene.

26. A reforming process according to claim 25 wherein said reformer catalyst comprises platinum, rhenium, chlorine and alumina.

27. A method of operating a reformer system comprising a first reactor having a first inlet for receiving a feed and a first outlet for discharging a first effluent said first reactor defines a first volume containing a first catalyst, a second reactor having a second inlet for receiving said first effluent and a second outlet for discharging a second effluent, said second reactor defines a second volume containing a second catalyst, a third reactor having a third inlet for receiving said second effluent and a third outlet for discharging a third effluent, said third reactor defines a third volume containing a third catalyst, a first conduit means, operatively connected to said first inlet, for conveying said feed to said first reactor, a second conduit means, operatively connected to said first outlet and said second inlet, providing fluid-flow communication between said first reactor and said second reactor and for conveying said first effluent from said first reactor to said second reactor, a third conduit means, operatively connected to said second outlet and said third inlet, providing fluid-flow communication between said second reactor and said third reactor and for conveying said second effluent from said second reactor to said third reactor, a fourth conduit means, operatively connected to said third outlet, for conveying said third effluent from said third reactor, said method comprising the steps of:

charging a substantially water-free and substantially chlorine containing compound-free hydrocarbon feed comprising a reformable hydrocarbon to said reformer system operated under reforming conditions through said first conduit means; and during the charging step, sequentially introducing into said first conduit means, said second conduit means, and said third conduit means, without the simultaneous introduction of water, a chloriding agent in an amount sufficient to provide a concentration of said chloriding agent in said substantially water-free and substantially chlorine containing compound-free hydrocarbon feed in the range of from about 0.1 ppmw to about 10 ppmw.

28. An improved reforming process according to claim 27 wherein said substantially water-free hydrocarbon feed contains less than about 5 ppmw of water.

29. A reforming process according to claim 28 wherein said chloriding agent is a nonmetallic organic chloride.

30. A reforming process according to claim 29 wherein said reformer catalyst comprises platinum and alumina.

31. An improved reforming process according to claim 27 wherein the amount of said chloriding agent introduced into said first conduit means, said second conduit means, and said third conduit means is so as to provide a concentration of said chloriding agent in said substantially water-free hydrocarbon feed of from about 0.2 ppmw to about 5 ppmw.

32. An improved reforming process according to claim 31 wherein said substantially water-free hydrocarbon feed contains less than about 1 ppmw of water.

33. A reforming process according to claim 32 wherein said chloriding agent is perchloroethylene.

34. A reforming process according to claim 33 wherein said reformer catalyst comprises platinum, rhenium, chlorine and alumina.

* * * * *

UNITED STATES PATENT AND TRADEMARK OFFICE

CERTIFICATE OF CORRECTION

PATENT NO. : 6,458,266 B1
DATED : October 1, 2002
INVENTOR(S) : Fan-Nan Lin and John S. Parsons It is certified that error appears in the above-identified patent and that said Letters Patent is hereby corrected as shown below:

Column 17,
Lines 21-26, please delete claim 6.

Column 18,
Lines 16-21, please delete claim 15.

Signed and Sealed this

Twenty-sixth Day of August, 2003

JAMES E. ROGAN
*Director of the United States Patent and Trademark Office*